US008701584B2

(12) United States Patent
Kalwa

(10) Patent No.: US 8,701,584 B2
(45) Date of Patent: Apr. 22, 2014

(54) UNMANNED UNDERWATER VEHICLE AND METHOD FOR OPERATING AN UNMANNED UNDERWATER VEHICLE

(75) Inventor: Jörg Kalwa, Weyhe (DE)

(73) Assignee: Atlas Elektronik GmbH, Bremen (DE)

( * ) Notice: Subject to any disclaimer, the term of this patent is extended or adjusted under 35 U.S.C. 154(b) by 297 days.

(21) Appl. No.: 13/221,197

(22) Filed: Aug. 30, 2011

(65) Prior Publication Data

US 2012/0048171 A1 Mar. 1, 2012

(30) Foreign Application Priority Data

Aug. 31, 2010 (DE) ..... 10 2010 035 898

(51) Int. Cl.
*B63G 8/00* (2006.01)

(52) U.S. Cl.
USPC ..... 114/313

(58) Field of Classification Search
USPC ..... 114/312, 313
See application file for complete search history.

(56) References Cited

U.S. PATENT DOCUMENTS 3,757,725 A * 9/1973 Horn ..... 114/173
5,143,009 A 9/1992 Laukien
5,596,549 A 1/1997 Sheriff
8,459,196 B2 * 6/2013 Provencher et al. ..... 114/222
2008/0257140 A1 10/2008 Blohm et al.

FOREIGN PATENT DOCUMENTS

DE 102004062122 B3 12/2005
WO 8700501 1/1987

OTHER PUBLICATIONS

Canadian Office Action dated Aug. 8, 2012, corresponding with Canadian Application No. 2,747,128.

* cited by examiner

*Primary Examiner* — Daniel V Venne
(74) *Attorney, Agent, or Firm* — Fitch, Even, Tabin & Flannery LLP

(57) ABSTRACT

The invention relates to an unmanned underwater vehicle having at least one sensor unit (7) which can be used to acquire sensor information (8) relating to objects in the area surrounding the underwater vehicle (1). The invention also relates to a method for operating the unmanned underwater vehicle (1). In order to sense structures and contours of objects under water as quickly and accurately as possible, the invention provides for the at least one sensor unit (7) to be arranged such that it can be moved in a tangential direction (12) of the underwater vehicle, that is to say tangentially with respect to the longitudinal axis (14) of the underwater vehicle (1) or an axis running parallel to the longitudinal axis, and can be positioned in the circumferential direction (12) by a positioning device (13) to which the sensor information (8) can be specified.

13 Claims, 4 Drawing Sheets

UNMANNED UNDERWATER VEHICLE AND METHOD FOR OPERATING AN UNMANNED UNDERWATER VEHICLE

CROSS-REFERENCE TO RELATED APPLICATION

The present application claims the priority of German Patent Application No. 10 2010 035 898.3, filed Aug. 31, 2010, the subject matter of which, in its entirety, is incorporated herein by reference.

BACKGROUND OF THE INVENTION

The invention relates to an unmanned underwater vehicle having at least one sensor unit that can be used to acquire sensor information relating to objects in the area surrounding the underwater vehicle. The invention also relates to a method for operating an unmanned underwater vehicle with at least one sensor unit used to acquire sensor information relating to objects in the area surrounding the underwater vehicle.

In contrast to manned missions, unmanned underwater vehicles can reach greater working depths and can operate in environments which are too dangerous for divers or manned underwater vehicles. Unmanned underwater vehicles are also able to perform most of the tasks which were previously carried out by larger research ships. Unmanned underwater vehicles therefore afford a large cost advantage over manned systems. Unmanned underwater vehicles can be roughly subdivided into remotely controlled underwater vehicles (ROV=Remotely Operated Vehicle) and autonomous underwater vehicles (AUV=Autonomous Underwater Vehicle).

Remotely controlled underwater vehicles (ROV) are generally remotely controlled via a connection cable, usually by a human operator. Remotely controlled underwater vehicles are preferably used for missions with locally limited, more detailed investigations under real-time conditions, the underwater vehicle often also having to act on an object under water, for example for repair purposes.

Autonomous underwater vehicles (AUV) perform their respective mission without being continuously monitored by human operators but rather follow a specified mission programme. Autonomous underwater vehicles comprise their own power supply and do not require any external communication during the mission. After the mission programme has been carried out, the autonomous underwater vehicle independently surfaces and is then recovered. An autonomous underwater vehicle is particularly suitable for large-scale reconnaissance under water and investigates the underwater environment, generally without contact with sensed objects under water.

Unmanned underwater vehicles, that is to say both remotely controlled underwater vehicles (ROV) and autonomous underwater vehicles (AUV), comprise at least one sensor unit which can be used to acquire sensor information relating to objects in the area surrounding the underwater vehicle. Remotely controlled underwater vehicles often use a camera, as a sensor unit, to record images under water which are displayed to the operator in order to make it possible for the operator to carry out an inspection or manipulations under real-time conditions using images of an object. Autonomous underwater vehicles require sensor units to sense objects in the area surrounding the underwater vehicle for various tasks. The sensor information is used, inter alia, for navigation. The sensor information is also used to locate objects or to calculate manoeuvres for the closer inspection of underwater objects which have been found.

Both large-scale reconnaissance or investigation and locally limited work under real-time conditions are required in a multiplicity of underwater missions, for example when inspecting and, if necessary, repairing offshore installations, for example pipelines. Walls, in particular vertical walls, often need to be examined under water, the walls having to be covered over a long inspection range according to their length under water. If damage is detected, the damage must be diagnosed in more detail and repaired, if necessary. Such fields of use of unmanned underwater vehicles are, for example, harbour inspections including the inspection of channel walls, quay walls, sheet pile walls etc., in particular with regard to the undermining of such underwater walls. Harbour inspections can also concern the examination and possibly manipulation of hulls. During such underwater missions, objects having extensive structures and contours need to be investigated and must be comprehensively scanned by the sensors of the underwater vehicle. In this case, the structures and contours of the investigated object may change, with the result that the sensor unit cannot sense the structures and contours of the object at all or can sense them only inadequately.

The sensor units are permanently mounted in known unmanned underwater vehicles but it is not possible to adapt the sensor unit to changing structures and contours of the object to be investigated. Control manoeuvres of the underwater vehicle are therefore regularly needed to bring the sensors into new positions with respect to the underwater body to be investigated in order to obtain suitable sensor information. Adjustment manoeuvres therefore often have to be carried out by an operator when investigating extensive underwater bodies such as underwater walls or ship walls, thus slowing down the performance of the mission.

So-called pan-tilt units are known from monitoring technology, which are a mechanical gearbox, which can carry out tilt movements and pan movements in a coordinated manner, and in which a camera tracks a target. Such pan-tilt units are used, in particular, to monitor rooms, the camera sensing movements, in particular of persons who intrude. Such pan-tilt units are not suitable for use in unmanned underwater vehicles since the camera and possibly the light source are manually set and oriented by an operator and a large amount of time is therefore needed to adjust the sensors. On account of the remotely controlled operation of the pan-tilt units, such systems are, in particular, not suitable for autonomously operating underwater vehicles (AUVs).

The invention is based on the problem of sensing structures and contours of objects under water as quickly and accurately as possible.

SUMMARY OF THE INVENTION

According to a first aspect of the invention, the above problem generally is solved with an unmanned underwater vehicle having at least one sensor unit that can be used to acquire sensor information relating to objects in the area surrounding the underwater vehicle wherein, according to the invention, the at least one sensor unit is arranged such that it can be moved, in particular pivoted, rotated or displaced, in a tangential direction of the underwater vehicle and can be positioned in the tangential direction by a positioning device to which the sensor information can be specified.

According to a second aspect of the invention, the above problem generally is solved by a method for operating an unmanned underwater vehicle with at least one sensor unit used to acquire sensor information relating to objects in the area surrounding the underwater vehicle, wherein the sensor information is specified to a positioning device and the positioning device positions the sensor unit by moving the sensor unit in a tangential direction of the underwater vehicle tangentially with respect to the longitudinal axis of the underwater vehicle or an axis running parallel to the longitudinal axis.

Movability in the tangential direction denotes movability tangentially with respect to the longitudinal axis of the underwater vehicle or an axis running parallel to the longitudinal axis. The tangential direction is, in particular, a direction of rotation about this longitudinal axis or the axis running parallel to the longitudinal axis. The tangential direction in which the sensor unit is movably arranged is on a plane which is perpendicular to a longitudinal axis of the underwater vehicle. The longitudinal axis corresponds to straight-ahead travel of the underwater vehicle. Moving the sensor unit makes it possible to very quickly orient the sensor unit to an area to be investigated and to adapt it to the structure of the object to be investigated. In this case, the sensor unit can be automatically oriented according to the invention by the positioning device without having to involve an operator.

As a result of the fact that the sensor unit can be oriented, the sensor unit can sense a considerably larger area by changing the sensing range of the sensor unit in the case of large structures, for example quay walls or hulls. In addition, the orientation according to the invention makes it possible to sense structures and contours which are at a particular position outside the sensing range of the sensor unit. For example, an orientation of the sensor unit may also sense overhangs, in particular at precipices, or generally objects under water. When large structures are sensed with the inventive positioning of the sensor unit, the sensed structures are advantageously stored in order to compare the data relating to these structures, which have thus been stored, with the sensor information from a subsequent investigation of the same structure. As soon as changes or unusual features of the structure are sensed, the sensor unit is positioned in the direction of the unusual feature found, for example damage to a harbour wall or abnormalities on a hull.

The sensor unit is advantageously arranged on a sensor carrier which is arranged on a hull of the underwater vehicle such that it can be rotated in the tangential direction, that is to say the sensor carrier can be rotated about the longitudinal axis or an axis running parallel to the longitudinal axis. The positioning device can use an actuator of the sensor carrier to rotate the sensor carrier, with the result that the sensor unit is pivoted and is thus positioned in the tangential direction of the underwater vehicle. During positioning, the rotational angle position of a rotatable sensor carrier is changed in the tangential direction.

In one preferred refinement of the invention, the sensor carrier is in the form of a rotatable sensor head which is arranged on a bow of the underwater vehicle. In this manner, the leading region of the underwater vehicle is sensed in an optimal manner and the sensor unit is also provided at a location which is favourable in terms of flow mechanics.

In another advantageous embodiment of the invention, the sensor carrier is in the form of a sensor ring which is rotatably arranged on the periphery of the hull.

The sensor unit is advantageously arranged such that it can be pivoted in a pivoting direction tangentially with respect to an axis which runs perpendicular to the longitudinal axis or perpendicular to an axis running parallel to the longitudinal axis. The sensor unit can be positioned by the positioning device in this pivoting direction. In this manner, the positioning device can orient the sensor unit accurately and quickly with respect to the object to be investigated or the section of a structure both in the tangential direction and in the pivoting direction, that is to say with a movement via two axes of rotation.

With one preferred automatic orientation of the sensor unit, the positioning device positions the sensor unit according to a criterion based on the sensor information. In this case, the sensor information determined by the sensor unit is evaluated and reacts to itself while the sensor unit is being displaced, with the result that the sensor unit can be positioned very quickly according to a particular criterion.

For each item of sensor information acquired, a distance from an object is advantageously determined and the magnitude of the distances determined is used as the criterion for positioning the sensor unit. In this case, the information relating to the distance from the object can be derived from the respective sensor information in every rotational angle position of the sensor unit. In order to acquire the sensor information relating to objects in the area surrounding the underwater vehicle, an active sensor unit comprising a transmitting unit and a receiver unit, which can be used to acquire reflected sensor information, is advantageously provided. The distance to the target can be determined in this manner from the sensor information. In this case, the active sensor unit also senses emission-free objects, for example objects which do not emit any noise.

In one advantageous embodiment of the invention, the active sensor unit comprises optical sensors whose camera provides images as the sensor information. The structure of the object to be investigated and also local areas of particular interest, for example damage, can easily be seen or derived from the photographs from the camera.

In one preferred embodiment of the invention, the sensor unit comprises acoustic sensors. A sonar sensor unit can be used to determine distances to an object and the direction to this object.

A contour of an object in the area surrounding the underwater vehicle is advantageously determined from the acquired sensor information and the sensor unit is oriented in a direction specified for the determined contour. In this case, the positioning device senses a variation in sensor information from different directions and determines the respective distance to the object in the area surrounding the underwater vehicle. The contour of the object in the area surrounding the underwater vehicle can be derived from the variation in distances which is obtained in this manner. The sensor unit is then oriented in the direction of one of the items of sensor information which is selected from the variation in sensor information according to a criterion specified for the determined contour. In one advantageous embodiment, specifications for orienting the sensor unit are electronically stored or can be stored for particular contours in the positioning device.

This sensor information is advantageously provided by a multi-beam active sonar, that is to say a sonar having a multiplicity of reception directional characteristics which point in different directions. In a sensing sector, the multi-beam active sonar provides a multiplicity of items of sensor information, each of which is assigned a direction and a distance. With suitable tuning of the active sonar and corresponding evaluation, contours are derived from the acoustic sensor information and can also be optically displayed if necessary, for example on monitors. A sonar also enables accurate positioning of the sensor carrier and adaptation to changing contours and structures in situations in which optical sensor units are less effective, for example in murky waters.

The criterion for orienting the sensor unit is preferably the magnitude of the determined distances. In this case, an orientation according to the longest distance determined or the shortest distance may be specified for the respective contour. Particular distances according to particular angular relationships between the sensor unit and the structure or contour to be investigated can also be specified as a criterion for the orientation.

In the case of flat contours such as underwater walls, the sensor unit is advantageously oriented in the direction corresponding to the shortest distance from an object, with the result that the sensing range of the sensor unit is optimally used. In the case of other contours, other criteria may be specified for the distance in order to position the sensor unit. For example, in the case of corner structures, for example when investigating a corner enclosed by a wall on a base, the sensor unit is advantageously positioned at the furthest distance which was previously determined when evaluating the sensor information.

If, during operation of the underwater vehicle, it is determined that the current position of the sensor unit no longer corresponds to the criterion specified for the contour, the position of the sensor unit is tracked to the criterion. The rotatable sensor carrier is moved with the at least one sensor unit in an automated process until the orientation corresponds to the specified criterion. Automatic orientation is thus carried out, for example, during operation of a remotely controlled underwater vehicle without an operator having to intervene.

Another advantageous embodiment of the invention provides for transmitting a light image in order to orient a sensor unit with respect to an object to be investigated, the sensor unit sensing a projection of the light image on the object. When evaluating the sensor information, the projection is compared with the transmitted light image and an incongruity between the projection and the original light image is determined and the geometry of the original light image is used as the criterion for positioning the sensor unit. The sensor carrier and thus the sensor unit are oriented according to a discrepancy which has been determined, by being moved in the circumferential direction and/or pivoting direction, in such a manner that the projection sensed in this manner is as congruent with the light image as possible. This procedure is based on the knowledge that, when the light image does not impinge on a surface in a perpendicular manner, the projection is distorted according to the inclined structure of the object.

The light image is preferably produced using laser light, with the result that there is a long range. For this purpose, a laser projection system is provided in the sensor carrier, for example the sensor head.

Changing the orientation of the sensor unit also changes the geometry of the projection, from which it is possible to draw conclusions with regard to the difference between the actual position of the sensor unit and the optimum desired sensor unit. A light image with parallel lines is advantageously used, an oblique, that is to say no longer parallel, position of the lines on the projection resulting in the event of a non-frontal position of the sensor unit. A light image with crossed bundles of lines each with parallel lines is preferably transmitted, thus making it possible to draw conclusions with regard to the orientation of the sensor unit in two dimensions.

The movable sensor carrier advantageously comprises both a laser projection system with a camera as an optical sensor unit and an active sonar (multi-beam sonar). In this case, both systems can be used together if necessary Further advantageous embodiments emerge from the dependent claims and from the exemplary embodiments which are explained in more detail below using the drawing.

DETAILED DESCRIPTION OF THE INVENTION

Figure 1:
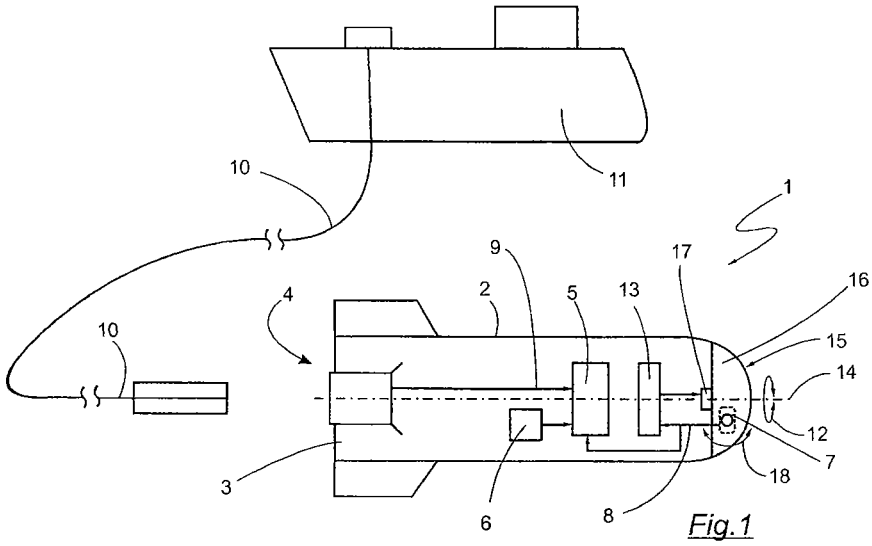
FIG. 1 shows a schematic side view of an unmanned underwater vehicle.

FIG. 1 shows an unmanned underwater vehicle 1 having a hull 2 which is cylindrical, in particular tubular or torpedo-shaped, at least in sections and on the stern 3 of which a main drive 4 is arranged. In the exemplary embodiment shown, the unmanned underwater vehicle 1 is an autonomous underwater vehicle which carries out its mission without communication. For this purpose, a control device 5, to which operating software and/or a mission programme stored in a memory 6 specify/specifies control information, is arranged in the hull 2.

The underwater vehicle 1 has at least one sensor unit 7 whose sensor information 8 is input to the control device 5. The control device 5 uses its operating software to autonomously determine control commands for the operating devices of the underwater vehicle 1, for example for navigation or for controlling the drive 4 and steering the underwater vehicle 1, on the basis of the control information specified to it by the mission programme 6 and the sensor information 8.

In an alternative exemplary embodiment, the unmanned underwater vehicle 1 can be remotely controlled and receives control information 9, via a connection cable 10, from a system platform which is illustrated as an ocean vessel 11 in FIG. 1. The system platform 11 may also be stationary in order to carry out underwater inspections tied to a location using a remotely controlled underwater vehicle (ROV).

The at least one sensor unit 7 is arranged such that it can be moved in a tangential direction 12 of the underwater vehicle and can be positioned in the tangential direction 12 by a positioning device 13. The positioning device 13 comprises an electronic computer unit which is used to evaluate the received sensor information 8 according to operating software and to determine output values. The positioning device 13 may be an independent computer unit or else may be integrated in the control device 5.

In this case, the tangential direction 12 in which the sensor unit 7 can be positioned is tangential with respect to the longitudinal axis 14 of the underwater vehicle 1. In this case, the longitudinal axis 14 corresponds to the straight-ahead travel of the underwater vehicle 1 and runs between its stern 3 and its bow 15.

The sensor unit 7 can be moved in the circumferential direction 12 by virtue of the fact that the sensor unit 7 is arranged on a sensor carrier which is arranged on the hull 2 such that it can be rotated in the tangential direction 12. In the exemplary embodiment shown, the sensor carrier is in the form of a rotatable sensor head 16 which is arranged on the bow 15 of the underwater vehicle 1.

The bow 15 provides a location, which is favourable in terms of flow mechanics, for arranging the sensor unit 7.

The sensor head 16 can be rotated in the circumferential direction 12 by an actuator 17, the actuator 17 receiving actuating commands from the positioning device 13 for setting the rotational angle position of the sensor head 16 and for the associated positioning of the sensor unit 7.

In addition to the tangential direction 12, the sensor unit 7 is also arranged such that it can be moved in a pivoting direction 18, that is to say can be pivoted about an axis perpendicular to the longitudinal axis 14 or perpendicular to an axis parallel to the longitudinal axis 14 of the underwater vehicle 1. The sensor unit 7 can be positioned by the positioning device 13 in the pivoting direction 18. For positioning in the pivoting direction 18, the sensor head 16 comprises actuating means which are not illustrated here and are controlled by the positioning device 13. An actuator which is controlled by the positioning device 13 by means of actuating commands may likewise be provided as a means for positioning in the pivoting direction 18.

Figure 2:
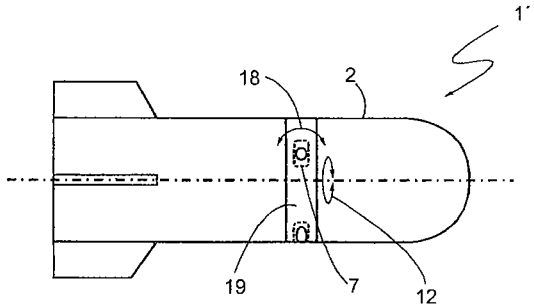
FIG. 2 shows a schematic side view of a second exemplary embodiment of an unmanned underwater vehicle.

In the exemplary embodiment according to FIG. 2, the rotatable sensor carrier is in the form of a sensor ring 19 which is rotatably arranged on the periphery of the hull 2. The rotatable sensor ring 19 is provided instead of the rotatable sensor head 16 in the exemplary embodiment according to FIG. 1. The sensor ring 19 can be rotated in the tangential direction 12 of the underwater vehicle 1, the sensor units 7 of the sensor ring 19 being able to be positioned in a pivoting direction 18, as already described with respect to FIG. 1. The sensor ring is advantageously hinge-mounted and comprises a housing made of a material which transmits the operating signal from the sensor unit 7. The sensor ring 19 advantageously consists of glass, which is transparent, and/or of a material which transmits sound.

For the rest, the unmanned underwater vehicle 1' according to FIG. 2 corresponds to the design already described with respect to FIG. 1. In particular, the sensor units 7 are positioned in the tangential direction 12 and in the pivoting direction 18 by a positioning device which is not illustrated in FIG. 2, with the result that optimum orientation with respect to an object to be investigated is effected.

The sensor unit 7 is an active sensor comprising a transmitting unit and a receiver unit, with the result that the sensor unit can sense signals transmitted from it after reflection at an object and can provide corresponding sensor information 8 relating to the object. In particular, the respective distance to the target can be derived from the sensor information 8 from an active sensor unit. The sensor unit 7 which is used to position the sensor head 16 may be an optical sensor unit or a sonar sensor unit.

The sensor head 16 may have a plurality of sensor units 7 which are distributed in the tangential direction, with the result that rotational movements of the sensor head 16 are reduced during positioning. In one advantageous exemplary embodiment, both optical sensor units and sonar sensor units are arranged on the sensor head 16 or else further sensor units for investigating the area surrounding the underwater vehicle 1 are provided. Of the sensor units arranged on the sensor head 16, at least one is used to position the sensor head 16 and is connected to the positioning device 13. In this case, the sensor signals 8 from the sensor unit 7 used for positioning can also be used to orient other sensor units arranged on the sensor head 16. Corresponding algorithms can be stored in the positioning device.

In one preferred exemplary embodiment, the sensor head 16 comprises a camera and a laser projection system as well as an active sonar (multi-beam sonar).

Since the sensor information 8 is specified to the positioning device 13 and the positioning device 13 adjusts and positions the sensor device 7, the control information reacts to itself, with the result that the sensor orientation is optimized during the positioning operations.

Figure 3:
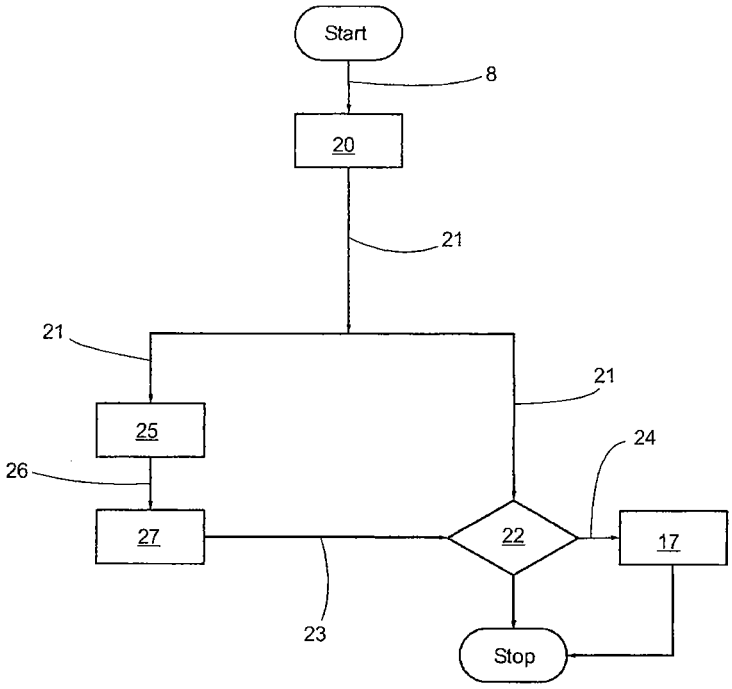
FIG. 3 shows a flowchart of an orientation of a sensor unit.

One exemplary embodiment for positioning the sensor unit 7 is explained below using the flowchart according to FIG. 3. Proceeding from the start, the positioning device acquires the sensor information 8 which may contain information relating to an object in the area surrounding the underwater vehicle or contains in the area surrounding an object. The distance 21 to the object is determined in a computation operation for distance determination 20. The distance 21 determined is compared with a specified criterion 23 with respect to the magnitude of the distance in a comparison step 22. In this case, the specified criterion 23 may be the shortest possible distance or the longest possible distance or else another statement with respect to the distance.

In the comparison step 22, the distance in the current sensor information 8 is compared with previously acquired values. If the change in the distance determined does not correspond to the criterion, an actuating command 24 is transmitted to the actuator 17. In that case, the rotatable sensor carrier is rotated further, with the result that the sensor unit is positioned differently. As soon as the distance determined satisfies the criterion, the sensor unit has been optimally positioned.

The criterion 23 is specified on the basis of the respective contour of an object. In this case, in addition to the comparison step 22, the distance 21 is used in a contour determination process 25. During the positioning operation, that is to say when the sensor carrier moves, the positioning device senses a variation in sensor information 8 from different directions. The respective distance 21 to the object in the area surrounding the underwater vehicle is determined from the sensor information 8. A contour 26 of the object in the area surrounding the underwater vehicle can be derived from the variation in distances which is obtained in this manner. A criterion specification 27 determines the appropriate criterion 23 of the magnitude of the distance for the contour 26 determined. Appropriate criteria 23 are determined and stored in advance for particular contours 26.

As a result of the positioning according to the specified magnitude of the distance 21, the sensor unit is automatically oriented in the direction of that item of sensor information 8 which is selected from the variation in sensor information according to the criterion 23 specified for the contour 26 determined.

Figure 4:
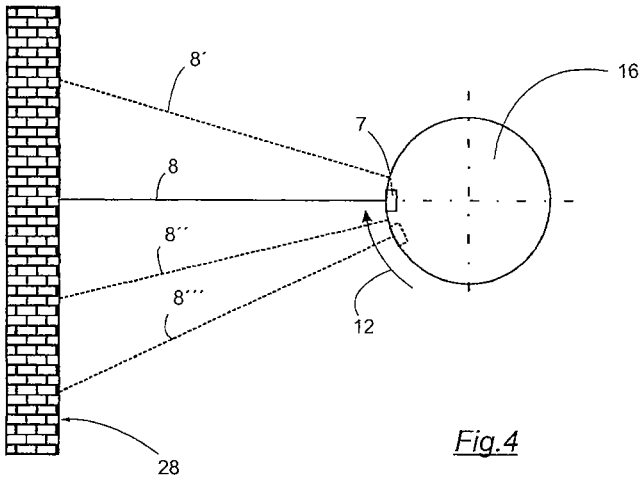
FIG. 4 and FIG. 5 show plan views of a rotatable sensor carrier of an unmanned underwater vehicle according to FIG. 1 or FIG. 2 in the area surrounding an underwater body.
Figure 5:
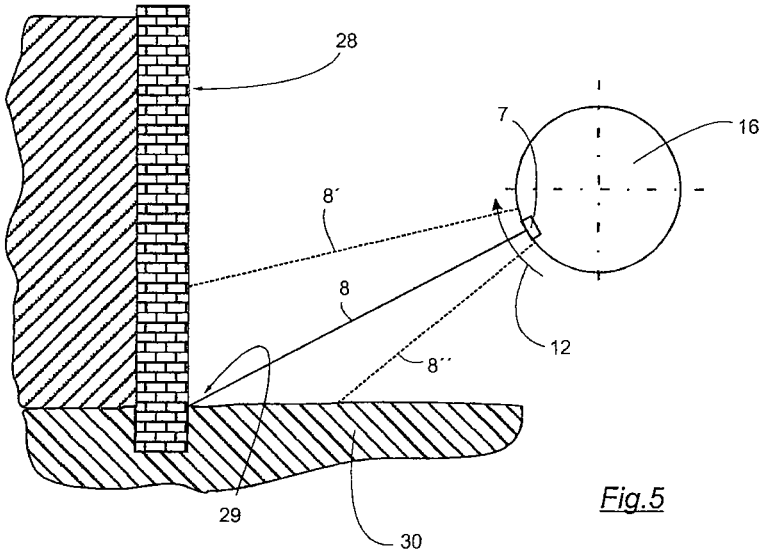

Exemplary embodiments of the orientation of the sensor unit according to the distance determined are shown in FIG. 4 and FIG. 5, each of which illustrates a plan view of the sensor head 16 of an underwater vehicle. In the exemplary embodiment according to FIG. 4, the underwater vehicle is in front of a flat contour, for example a vertical harbour wall 28. As soon as the sensor unit 7 of the sensor head 16 locates the harbour wall 28, the sensor unit 7 is positioned. In order to position the sensor unit 7 with respect to the wall 28, the sensor head 16 is rotated in the circumferential direction 12, as a result of which the sensor unit 7 transmits and receives signals in different rotational angle positions and the positioning device therefore senses a variation in sensor information 8, 8', 8", 8'" from the sensor unit 7 from different directions.

For each item of acquired sensor information 8, 8', 8", 8'", a distance to the object, the wall 28 in this case, is determined. The contour of the wall 28 in the sensing range of the sensor unit can be determined from the different distances in different directions. After the contour of the object, namely the flat surface of a wall 28 in this case, has been determined, the sensor unit 7 is brought into a rotational angle position which corresponds to the direction of that item of sensor information 8, 8', 8", 8'" whose determined distance corresponds to the specified criterion for the magnitude of the distance, for example corresponds to the criterion of the longest distance. In the exemplary embodiment of a flat surface shown, the shortest distance is specified as the criterion for the magnitude of the distance for the purpose of positioning the sensor unit 7.

As long as the distances in the current sensor information become shorter, the sensor head continues its positioning movement. The criterion of the shortest distance is determined to have been reached as soon as a distance which becomes longer is determined for the first time. The sensor unit 7 is thus accurately frontally positioned in front of the wall and senses the largest possible area in this case.

The sensor unit 7 is positioned automatically and thus in a very rapid manner. The automatic positioning and adjustment of the sensor unit makes it possible to sense changing structures and to map a plurality of structures in a relatively short period of time, for example vertical walls with different structures, hulls or else overhangs on underwater mountains. In this case, a sector in the area surrounding the underwater vehicle, which could be poorly sensed in the previous orientation of the sensor unit, can also be investigated by positioning the sensor head. When investigating overhangs for example, the sensor can thus be rotated upwards from a downwardly directed position. In addition, larger sensor ranges can be sensed as a result of the automatic positioning since the sensor unit is automatically oriented in the respective optimum position with respect to the surface to be investigated.

The sensor unit 7 is positioned automatically and independently of an operator, with the result that, in the case of a remotely controlled underwater vehicle (ROV), the vehicle can still be manually controlled, while the sensor unit is automatically positioned at the same time in the event of changing surface structures of the objects to be investigated.

If the sensor unit 7 is a sonar, positioning can be effected in a simple refinement using a three-point measurement, sensor information being recorded in three different positions of the sensor carrier and the respective distance from the reflective object being determined therefrom. The direction of the shortest distance is selected for positioning the sensor unit from the variation in three distances according to the criterion specified for the contour, that is to say the shortest distance in the case of a flat surface. The sensor information is preferably acquired by a multi-beam active sonar, with the result that a variation in a plurality of items of sensor information from different directions is provided for the purpose of determining the contour.

For different contours, different criteria for determining the direction from the variation in the determined sensor information and associated distances are specified to the positioning device. FIG. 5 shows, by way of example, a situation in which an object to be investigated forms a corner 29. This situation is typical of the investigation of harbour installations, where vertical walls 28, for example, have been erected on a base 30. Accurate investigation and quick and precise positioning are desirable, in particular, in the region of the base 30 in order to detect undermining of the wall 28. When investigating corners 29, the longest distance is specified for this contour as the criterion for the magnitude of the distance, according to which the sensor unit 7 is positioned.

In the manner already described with respect to FIG. 4, a variation in sensor information 8, 8', 8" is sensed during a movement of the sensor head 16 in the circumferential direction 12. If the presence of a corner contour results from evaluation of the sensor information 8, 8', 8", the longest distance is specified as the criterion for positioning the sensor unit 7. The sensor unit 7 is automatically positioned in the direction of the sensor information 8 with the longest distance to the underwater object, which corresponds exactly to the orientation with respect to the corner 29.

Figure 6:
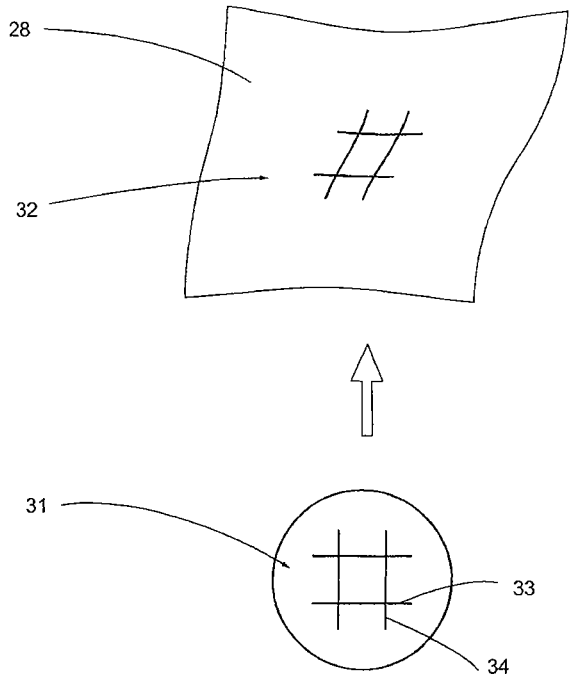
FIG. 6 shows a schematic illustration of an object having the projection from an optical sensor unit of the underwater vehicle according to FIG. 1 or FIG. 2.

FIG. 6 illustrates the positioning of an optical sensor unit, the sensor unit 7 (FIGS. 1 to 4) transmitting a light image 31 and sensing a projection 32 of the light image 31 on a wall 28 to be investigated. The sensor unit comprises a laser projection system and a camera for this purpose. The high energy density of the laser light makes it possible to project light images 31 onto the structures to be investigated even in murky waters.

If the wall 28 is not frontally in front of the sensor unit, the projection 32 is distorted. In order to optimally orient the sensor unit with respect to that area of the wall 28 which is to be investigated, a deviation of the geometry of the projection 32 from the transmitted light image is determined and the sensor unit is positioned in such a manner that the projection 32 is as congruent with the original light image 31 as possible. The (original) geometry of the light image 31 is used by the positioning device as the criterion for orienting the sensor unit 7.

In the exemplary embodiment shown, the light image 31 has two crossed bundles of lines each with parallel lines 33, 34. These line structures can be precisely represented using the laser light from the laser projection system. When the light image 31 is projected onto a wall 28 which is oblique with respect to the sensor unit, the projection 32 will not reproduce the crossed bundles of lines in a parallel manner but rather in a tilted or crooked manner. The suitable orientation measure can be derived from the angle between the lines which were originally parallel. The light image 31 with crossed bundles of lines and the two-dimensional information relating to the surface of the wall 28 to be investigated, as obtained therewith, can be used to precisely match and adapt the sensor unit to the structure of the wall 28 by means of positioning in the tangential direction 12 and pivoting direction 18 (FIG. 1).

All of the features mentioned in the abovementioned description of the figures, in the claims and in the introductory part of the description can be used both individually and in any desired combination with one another. Therefore, the disclosure of the invention is not restricted to the described and/or claimed combinations of features. Rather, all combinations of features should be considered to be disclosed.

What is claimed is:

1. An unmanned underwater vehicle comprising:

at least one sensor unit for acquiring sensor information relating to objects in an area surrounding the underwater vehicle, wherein the at least one sensor unit is movable in a tangential direction of the underwater vehicle tangentially with respect to a longitudinal axis of the underwater vehicle, or an axis running parallel to the longitudinal axis; and a positioning device for positioning the sensor unit in the tangential direction based on the sensor information.

2. The unmanned underwater vehicle according to claim 1, characterized in that the sensor unit is arranged on a sensor carrier which is arranged on a hull of the underwater vehicle such that it can be rotated in the tangential direction, and wherein a controllable actuator of the sensor carrier is connected to the positioning device.

3. The unmanned underwater vehicle according to claim 2, characterized in that the underwater vehicle has a bow, and the sensor carrier has a rotatable sensor head arranged on the bow of the underwater vehicle.

4. The unmanned underwater vehicle according to claim 1, characterized in that the underwater vehicle includes hull and a sensor carrier, wherein the sensor carrier has a sensor ring which is rotatably arranged about a periphery of the hull of the unmanned underwater vehicle.

5. The unmanned underwater vehicle according to claim 1, characterized in that the sensor unit is positionable in a pivoting direction tangentially with respect to an axis which runs perpendicular to the longitudinal axis or perpendicular to the axis running parallel to the longitudinal axis.

6. The unmanned underwater vehicle according to claim 1, characterized in that the sensor unit is an active sensor unit and comprise a transmitting unit and a receiver unit, wherein the sensor unit is arranged and configured for sensing signals transmitted from the sensor unit after reflection at the object (s) to provide corresponding sensor information.

7. The unmanned underwater vehicle according to claim 1, characterized in that the sensor unit has optical sensors.

8. The unmanned underwater vehicle according to claim 1, characterized in that the sensor unit has acoustic sensors.

9. A method for operating an unmanned underwater vehicle with at least one sensor unit used to acquire sensor information relating to objects in an area surrounding the underwater vehicle, said vehicle having a positioning device for positioning the sensor, said method comprising providing the sensor information to the positioning device; and positioning the sensor unit wherein the positioning device positions the sensor unit by moving the sensor unit in a tangential direction of the underwater vehicle tangentially with respect to a longitudinal axis of the underwater vehicle, or an axis running parallel to a longitudinal axis of the underwater vehicle, wherein the positioning device positions the sensor unit based on the sensor information.

10. The method according to claim 9, characterized in that in said positioning the positioning device positions the sensor unit in a pivoting direction tangentially with respect to an axis which runs perpendicular to the longitudinal axis or perpendicular to the axis running parallel to the longitudinal axis.

11. The method according to claim 9, characterized in that the method further comprises computing determined distances relating to the objects and determining the magnitude thereof, and using a magnitude of determined distances as a criterion in orientating the sensor unit.

12. The method according to claim 9, characterized in that the sensor unit transmits a light image and records a projection of the light image on the object(s), said method including determining an incongruity between the projection and the light image, wherein a geometry of the light image is used a criterion in positioning the sensor unit.

13. The method according to claim 12, characterized in that the light image has crossed bundles of lines, wherein each bundle of lines consists of parallel lines.

* * * * *